United States Patent [19]

Schöffmann

[11] 3,978,909

[45] Sept. 7, 1976

[54] MOLD WITH CONVEX SIDEWALLS FOR CONTINUOUS CASTING MACHINES

[75] Inventor: Rudolf Schöffmann, Linz, Austria

[73] Assignee: Allis-Chalmers Corporation, Milwaukee, Wis.

[22] Filed: July 2, 1975

[21] Appl. No.: 592,382

Related U.S. Application Data

[63] Continuation of Ser. No. 429,702, Jan. 2, 1974, abandoned.

[52] U.S. Cl. ..... 164/273 R

[51] Int. Cl.[2] ..... B22D 11/00

[58] Field of Search ..... 164/82, 86, 273 R, 280, 164/283 R, 383 M

[56] References Cited

UNITED STATES PATENTS

| | | | |
|---|---|---|---|
| 3,292,216 | 12/1966 | Colombo | 164/273 R |
| 3,628,596 | 12/1971 | Easton et al. | 164/283 R |

FOREIGN PATENTS OR APPLICATIONS

| | | | |
|---|---|---|---|
| 1,508,802 | 11/1969 | Germany | 164/273 R |

*Primary Examiner*—Travis S. McGehee
*Attorney, Agent, or Firm*—Arthur M. Streich

[57] ABSTRACT

An open ended mold for a continuous metal casting machine is disclosed having a pair of sidewalls and a pair of end walls narrower than the sidewalls, which define an open ended mold cavity. The end walls each define a convex surface with a crest extending between the open ends of the mold, for casting therein a continuous strand having at least a shell of solidified metal and with the oppositely facing end surfaces each defining a continuous concave arch. The convex end walls of the mold are movable toward and away from each other between the sidewalls for casting such strands of different widths.

1 Claim, 3 Drawing Figures

MOLD WITH CONVEX SIDEWALLS FOR CONTINUOUS CASTING MACHINES

This is a continuation application of my application Ser. No. 429,702 filed Jan. 2, 1974, now abandoned.

CROSS REFERENCE TO RELATED PATENT APPLICATION

A continuous casting machine apparatus for forming a strand of cast metal as described in this application but so forming the strand after the strand emerges from a mold, is the subject of my copending patent application entitled "Apparatus For Continuous Casting A Metal Strand Shaped To Provide Concave Surfaces", Ser. No. 429,701 filed concurrently with this application.

BACKGROUND OF THE INVENTION

1. Field of the Invention

This invention relates to a mold for continuously casting slabs, billets and related products which have a basically quadrangular, normally rectangular, cross section. The operation of a continuous casting machine with a mold such as provided by this invention, involves charging a casting mold with liquid metal and precooling the metal in the mold for the purpose of forming a strand having a closed shell of solidified metal surrounding a still liquid core, with the strand leaving the mold and being supported after it has left the mold, at least on the opposite wide sides by means of support or guide rolls, as shown in my U.S. Pat. No. 3,710,847 of Jan. 16, 1973.

2. Description of the Prior Art

It is known to those familiar with this technology, and disclosed in my prior patents U.S. Pat. No. 3,589,429 of June 29, 1971 and U.S. Pat. No. 3,710,847 of Jan. 16, 1973, that a strand with only a relatively thin shell of solidified metal is formed in the mold of continuous casting plants. Complete solidification of the strand occurs in the so-called secondary cooling zone after leaving the mold. The strand shell formed in the mold, due to its relative thin walls and also due to the high temperature, is not able to resist the ferrostatic pressure of the liquid strand core enclosed by the shell. Therefore, supporting devices such as rolls, plates, lifting beams and similar devices have to be provided which prevent excessive bulging or tearing of the shell. The supporting devices provided have to be adjusted to accommodate the size of the strand being cast and must be precisely aligned with the mold which results in considerable adjusting and alignment work, especially for facilities which change cast sizes frequently. Also affected by frequent size changes is the total production rate of machines due to the interruptions in operating availability. The supporting devices may be damaged considerably during breakouts of the strand leaving the mold which causes additional repair costs.

Normally the rectangular cross section of the strand leaving the mold is determined by the shape of the exit cross section of the mold. For so-called slow casters and for continuous casting machines for strands with relatively small thickness, it is satisfactory sometimes to support the strand leaving the mold only on the wide sides, although small bulges due to the ferrostatic pressure may occur on the small sides. These small bulges may be acceptable in certain special cases.

For larger strand thicknesses as in the case of thick slabs, and also for so-called high speed casters as well as for essentially square strands, supporting devices are also necessary for the other two sides of the strand, that is for the narrow sides in the case of a rectangular format as shown in U.S. Pat. No. 1,841,297 of Jan. 12, 1932 and U.S. Pat. No. 3,318,366 of May 9, 1967. Otherwise these sides of the strand would bulge excessively due to the ferrostatic pressure and cause danger of breakouts. The adjustment and alignment of the rolls supporting the narrow sides must also be provided for since changing of strand width is much more common than changing of strand thickness.

Molds for casting strands having several cross sectional configurations, including molds with internal walls that are concave surfaces, are shown in the aforesaid U.S. Pat. No. 1,841,297 of Jan. 12, 1932, and U.S. Pat. No. 3,075,264 of Jan. 29, 1963.

SUMMARY OF THE PRESENT INVENTION

This invention relates to an open ended mold for a continuous casting machine, with at least two of its internal and facing walls each defining a convex surface with a crest extending between the open ends of the mold. According to a preferred embodiment of the present invention applied to a rectangular mold, it is the two narrower mold walls, which when viewed from above, that define convex surfaces, and these two convex walls may be movable toward and away from each other between the wider mold walls, to provide for changing the width of the strand of cast metal. The two convex surfaces within the mold produce a continuous strand of cast metal with a continuous concave arch formed in each of the narrower sides of a rectangular strand. This arch improves the total strength of the shell of the strand and especially the strength of the strand shell walls with the concave arch. This increase in strength will assure that bulging is prevented even if additional support for the strand shell walls beyond the mold is not provided. Therefore, it is satisfactory, normally, to support the strand beyond the mold, only on the wide sides, which remain flat. The thrust required to produce the arch is transferred into the mold walls supporting the strand shell on the wide sides. The same thrust also pushes the corners of the strand toward the outside so that they remain flat and parallel to the wide sides of the mold which provides a uniform strand thickness over the entire width of the strand.

The object of the present invention is to provide a continuous casting machine with a casting mold and support rolls following the mold, with the mold having at least two opposite strand forming and guiding walls in the mold itself which are shaped convex, preferably on the narrow side, thus resulting in the desired continuous concave arch in the narrow walls of the strand of cast metal.

Other features and objects of the invention that have been attained will appear from the more detailed description to follow with reference to an embodiment of the present invention shown in the accompanying drawing.

DESCRIPTION OF THE PREFERRED EMBODIMENT

Figure 1:
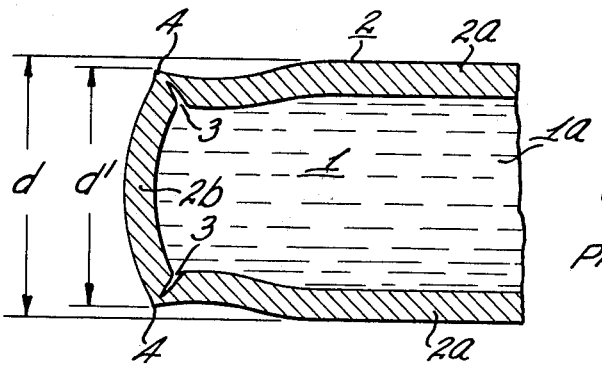
Fig. 1 PRIOR ART
FIG. 1 of the drawing shows schematically a fragmentary cross section view of a strand forming a slab, after leaving a mold according to teachings of the prior art.

Before beginning a description of a preferred embodiment of the present invention, reference is made to FIG. 1 which shows a fragmentary cross section view of a strand of cast metal forming a slab, after leaving a mold according to teachings of the prior art.

According to conventional teachings of the prior art, a slab 1 as shown in FIG. 1 emerges from a mold (not shown) with a strand shell 2 having relatively wide sidewalls 2*a* connected by a narrower end wall 2*b*, enclosing a still liquid strand core . . . As shown in FIG. 1, the narrow side 2*b* of the shell 2 is bulged to the outside by the ferrostatic pressure which causes the slab thickness to decrease from the desired value *d* to the actual value $d^1$ and which may cause cracks 3 in the corner area 4 which in turn may cause breakouts of the liquid core.

Due to the reduction in thickness in the corner zones, support rolls (not shown) for the wide sides will not be effective over the full width of the strand. Further, pinch rolls (not shown) cannot pull over the entire width which causes the pullout force to be reduced and which requires that a larger number of pinch roll strands be provided than would be necessary with perfectly flat sidewalls 2*a* or with a precisely rectangular cross section. The entire slab cross section is reduced by a certain amount, therefore, it is necessary to take safety precautions. The final shape of the slab also causes difficulties with reheating prior to the slab entering a rolling mill, and increases the danger of corner cracks in the first rolling pass, since the corner area is elongated due to the smaller thickness.

Figure 3:
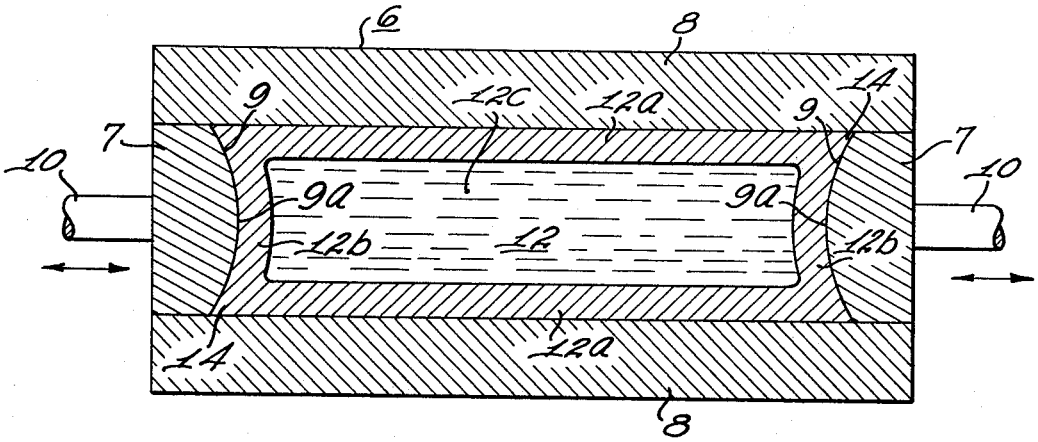
FIG. 3 of the drawing is a view taken along line III—III in FIG. 2 and viewing the structure in the direction indicated by arrows.
Figure 2:
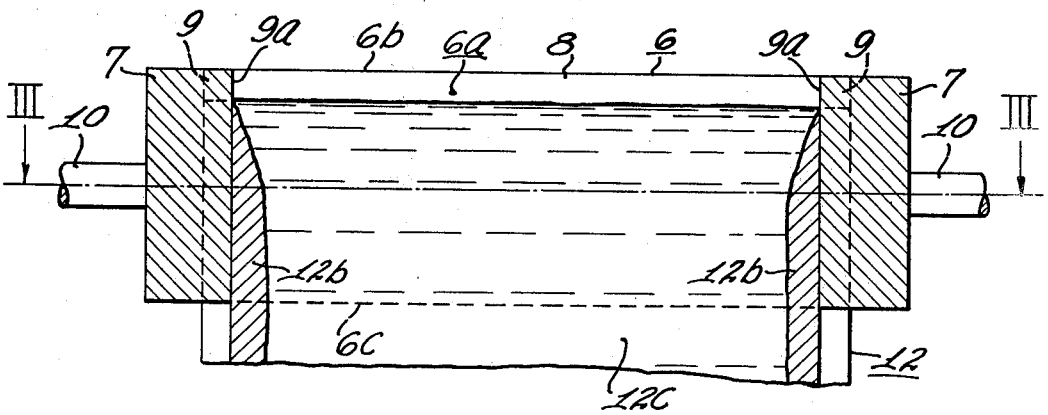
FIG. 2 shows diagrammatically in a side elevation view in section, a continuous casting machine mold according to the present invention.

All these disadvantages are avoided by the present invention, as shown in FIGS. 2 and 3. FIGS. 2 and 3 show a mold 6 having a pair of end walls 7 between a pair of wider sidewalls 8. As shown in FIG. 2, the mold 6 defines a mold cavity 6*a* with open ends 6*b* and 6*c*. The end walls 7 each define an inner surface 9 shown in FIG. 3 as being convex and having a crest 9*a*. As shown in FIG. 2 the convex surface 9 and crest 9*a* extend between the open ends 6*b* and 6*c* of the cavity 6*a*. Each of the end walls 7 may be provided with shafts 10 connected to suitable hydraulic fluid pressure operable motors (not shown) for moving the end walls 7 toward and away from each other as indicated by arrows, between the wider sidewalls 8.

Referring to FIGS. 2 and 3, in the operation of a continuous casting machine having a mold 6, liquid metal is poured into mold 6 and cooled by a suitable arrangement which may be, for example, an arrangement such as shown in my U.S. Pat. No. 3,610,322 of Oct. 5, 1971. As the metal is cooled in mold 6, a strand 12 is formed. As shown in FIG. 3, the strand 12 has a shell comprising flat side surfaces 12*a* and concave arched end surfaces 12*b*, and a still liquid core 12*c*. As shown in FIG. 2, the strand 12 formed as a shell with the still liquid core 12*c* then emerges from mold 6, and may be further cooled and handled in a manner conventional in this technology.

The invention therefore provides a mold and casting procedure which produces a strand 12 having a small concave arch on the opposite narrow sides 12*a*, but not limited to the narrow sides. This arch improves the total strength of the shell and especially the strength of the sidewalls 12*b* with the concave arch. This increase in strength will assure that bulging is prevented even if additional support for the sidewalls 12*b* beyond the mold 6 is not provided. Therefore, it is satisfactory, normally, to support the strand 12 only on the wide sides 12*a*, which remain flat. The thrust applied to shafts 10 required to produce the arch is transferred into the mold walls 8 supporting the strand 12 on the wide sides of sidewalls 8. The same thrust also pushes the corners 14 of the strand 12 toward the outside so that they remain flat with the wide sidewalls 8 which provides a uniform strand thickness over the entire width of the strand 12. Defects such as the cracks 3 shown in FIG. 1 are avoided by the mold shown in FIGS. 2 and 3, and safety precautions such as were necessary with molds according to the prior art, may be dispensed with.

From the foregoing detailed description of the present invention it has been shown how the object of the present invention has been attained in a preferred manner. However, modification and equivalents of the disclosed concepts such as readily occur to those skilled in the art are intended to be included in the scope of this invention. Thus, the scope of the invention is intended to be limited only by the scope of the claims such as are or may hereafter be, appended hereto.

I claim:

1. A mold for a continuous metal casting machine comprising:

a. a plurality of substantially vertical mold walls defining an open ended mold cavity;

b. said plurality of mold walls comprises a pair of vertical planar sidewalls spaced apart in mutually facing parallel arrangement and a pair of end walls narrower than said sidewalls, with said end walls spaced apart in mutually facing parallel arrangement between the sidewalls, said end walls each define a vertical surface which is continuously convex from one of said sidewalls to the other of said sidewalls and with a crest extending between the open ends of the mold, and the adjacent engaging surfaces of said sidewalls and end walls defining four acute included angular corners extending vertically between the upper and lower ends of the open ended mold cavity for casting therein a continuous strand having at least a shell of solidified metal with a pair of oppositely facing flat planar surfaces and a pair of oppositely facing surfaces each defining a continuous concave arch; and c. at least one of said convex end walls is movable between the flat and planar sidewalls and toward and away from the other of the convex end walls.

* * * * *